United States Patent [19]

Ross

[11] Patent Number: 4,482,977

[45] Date of Patent: Nov. 13, 1984

[54] ANALOG MULTIPLIER CIRCUIT INCLUDING OPPOSITE CONDUCTIVITY TYPE TRANSISTORS

[75] Inventor: David G. Ross, Fair Haven, N.J.

[73] Assignee: AT&T Bell Laboratories, Murray Hill, N.J.

[21] Appl. No.: 337,706

[22] Filed: Jan. 7, 1982

[51] Int. Cl.[3] ..... G06G 7/16

[52] U.S. Cl. ..... 364/841; 307/498; 307/529; 328/160; 364/813

[58] Field of Search ..... 364/841, 849, 813; 328/160, 161; 307/492, 498, 529

[56] References Cited

U.S. PATENT DOCUMENTS

| | | | |
|---|---|---|---|
| 3,304,419 | 2/1967 | Huntley, Jr. et al. | 364/841 |
| 3,689,752 | 9/1972 | Gilbert | 364/841 |
| 3,906,246 | 9/1975 | Okada | 364/849 X |
| 3,940,603 | 2/1976 | Smith | 364/849 |
| 4,156,283 | 5/1979 | Gilbert | 364/841 |
| 4,311,928 | 1/1982 | Hirata et al. | 328/161 X |
| 4,349,755 | 9/1982 | Bee | 328/160 X |

FOREIGN PATENT DOCUMENTS

| | | | |
|---|---|---|---|
| 56-88565 | 7/1981 | Japan | 364/841 |

OTHER PUBLICATIONS

Nedungadi: A Precise Large Current Ratio Integrated Gain Cell, Proceedings of the IEEE, vol. 68, No. 3, Mar. 1980, pp. 412–413.

Raytheon Co., Linear Integrated Circuit Data Book, No. 7597360, pp. 7–50 to 7–59.

*Primary Examiner*—Felix D. Gruber

*Attorney, Agent, or Firm*—Richard B. Havill

[57] ABSTRACT

A monolithic integrated analog multiplier circuit includes a series aiding connection of semiconductor junctions, each junction being arranged for conducting an input current from one of plural sources of input currents and for producing a voltage proportional to a logarithm of the input current conducted therethrough. A pair of opposite conductivity type transistors have their base-emitter circuits arranged to respond to the voltages produced at opposite ends of the series aiding connection for converting the voltage produced across the connection into an output collector current proportional to the product of the input currents.

11 Claims, 4 Drawing Figures

ANALOG MULTIPLIER CIRCUIT INCLUDING OPPOSITE CONDUCTIVITY TYPE TRANSISTORS

The invention relates to a monolithic analog multiplier circuit that is described more particularly as a multiplier circuit including opposite conductivity type transistors.

BACKGROUND OF THE INVENTION

In the prior art, a semiconductor analog multiplier circuit includes a series aiding string of diodes, each diode conducting an input current from one of plural sources and producing a junction voltage proportional to a logarithm of the current conducted therethrough. A pair of opposite conductivity type transistors convert the voltage across the string of diodes into an output current having a magnitude related to the magnitudes of the input currents. For producing an output current which has a magnitude proportional to the product of the magnitudes of the input currents, it is necessary to use diodes having an exponential coefficient equal to twice the exponential coefficient of the base-emitter junctions of the transistors.

A problem arises when the prior art multiplier circuit is fabricated as a monolithic integrated circuit. In such a circuit, the exponential coefficient of the diodes essentially equals the exponential coefficient of the base-emitter junctions of the transistors. With the exponential coefficients of the diodes and transistors being equal, the output current of the prior art multiplier circuit is proportional to the square root of the product of the input currents rather than being proportional to the product of the input currents as desired.

SUMMARY OF THE INVENTION

This problem is solved in a monolithic integrated analog multiplier circuit having a series aiding connection of semiconductor junctions, each semiconductor junction being arranged for conducting an input current from one of plural sources of input currents and for producing a voltage proportional to a logarithm of the input current conducted therethrough. A pair of opposite conductivity type transistors have their base-emitter circuits arranged to respond to the voltages produced across the connection and to convert them into an output collector current proportional to the product of the input currents.

BRIEF DESCRIPTION OF THE DRAWINGS

A better understanding of the invention may be derived by reading the following detailed description of some embodiments thereof with reference to the attached drawings wherein.

DETAILED DESCRIPTION

Circuits and Circuit Operation

Figure 1:
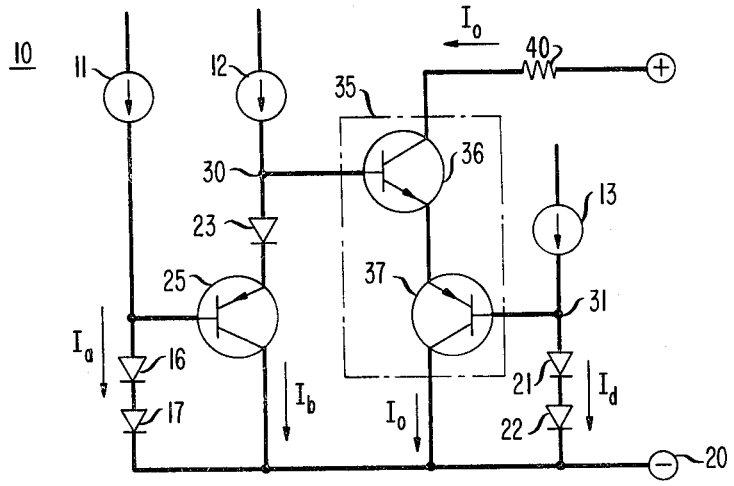
FIG. 1 is a schematic diagram of a multiplier circuit.

Referring now to FIG. 1, there is shown a simplified analog multiplier circuit 10, which may be fabricated advantageously as a monolithic circuit. With proper fabrication and biasing, this multiplier will perform analog multiplication very accurately at frequencies up to the microwave range while consuming very little power. As a monolithic integrated circuit, the components thereof all operate at the same temperature. A method for fabricating this circuit as a monolithic integrated circuit is described subsequently herein under a separate subtitle.

In FIG. 1, three input current sources 11, 12, and 13 are shown symbolically. Each of these current sources supplies a separate small magnitude analog input current to the circuit. The three input currents are conducted through separate input branch circuits which are isolated from one another.

Input current sources 11 and 13, respectively, supply input currents $I_a$ and $I_d$ in two of the branch circuits. Input current $I_a$ is conducted through a pair of diodes 16 and 17 to a source of negative potential bias 20. Input current $I_d$ is conducted through another pair of diodes 21 and 22 to the bias source 20. Each of the diodes 16, 17, 21, and 22 is a semiconductor junction. The diodes in each pair are connected in a series aiding relationship. All of the diodes 16, 17, 21 and 22 are biased to operate in the logarithmic portion of their characteristics.

Figure 2:
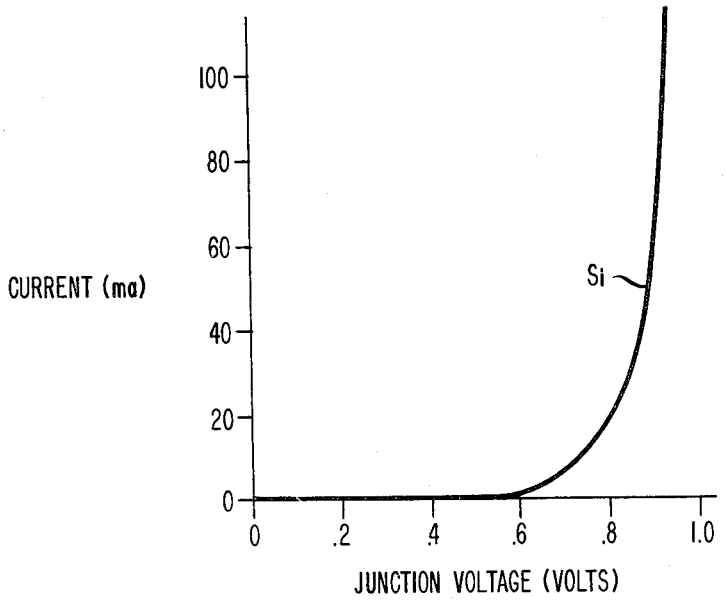
FIG. 2 is a characteristic curve for a semiconductor junction.

Referring now to FIG. 2, there is shown an exemplary I–V characteristic curve representing the characteristic of a silicon PN junction, such as the diodes 16, 17, 21 and 22. It is noted that for low magnitudes of current the transfer characteristics of FIG. 2 is represented mathematically by an expression $V=(KT/q)\mathbf{1}\mathrm{n}(I/I_s)$, where V is the semiconductor junction voltage, K is Boltzman's constant, T is temperature in degrees Kelvin, q is the charge on an electron, I is the forward current through the semiconductor junction, and $I_s$ represents saturation current. Thus the magnitude of the voltage produced across the junction is proportional to a logarithm of the magnitude of the current conducted through the junction.

In the arrangement of FIG. 1, the series aiding string of diodes 16 and 17 conducts the input current $I_a$. Each of the junctions in the string produces a voltage having a magnitude proportional to the logarithm of the magnitude of the current $I_a$. The entire voltage produced across the two semiconductor junctions is the sum of the voltage across the two diodes and is proportional to twice the logarithm of the magnitude of the current $I_a$.

Similarly the voltage across the string of diodes 21 and 22 is proportional to twice the logarithm of the magnitude of the current $I_d$.

Input current source 12 supplies another input current $I_b$ in a third input branch circuit. Current $I_b$ is conducted through a diode 23 and an emitter-collector path of a PNP transistor 25 to the bias source 20. The diode 23 and a base-emitter junction of the transistor 25 are connected in series aiding relationship for conducting the current $I_b$ from the input current source 12 through the diode 23 and the emitter-collector path of the transistor 25 to the bias source 20. Diode 23 and transistor 25 are biased to operate in the logarithmic portion of their characteristics. The previously described mathematical expression for the junction transfer characteristic applies to the operation of both the diode 23 and the base-emitter junction of the transistor 25. Beta of the transistor is large enough so that its base current is negligible and so that the current $I_a$ is isolated from the current $I_b$.

Voltages are produced across the diode 23 and the base-emitter junction of the transistor 25. Any voltage drop caused by ohmic resistance in the base-emitter junction is negligible. The voltage across the diode 23 is similar to the voltage across each of the diodes 16, 17, 21 and 22. For transistor 25, the current conducted through the emitter-collector path produces across its base-emitter junction a voltage having a magnitude proportional to the logarithm of the magnitude of that current. The entire voltage produced across the series aiding string of semiconductor junctions including the diode 23 and the base-emitter junction of the transistor 25 is proportional to twice the logarithm of the magnitude of the current $I_b$.

It is noted that there is a string of semiconductor junctions arranged in a series aiding connection between a circuit node 30 and the bias source 20. The junctions include a diode 23, the base-emitter junction of the transistor 25, and the diodes 16 and 17.

Voltages, each produced across one of those junctions, are summed across the entire series aiding connection. The resulting voltage between the node 30 and the bias source 20 is proportional to twice the sum of the logarithms of the magnitudes of the input currents $I_a$ and $I_b$ because there are two junctions carrying each input current.

Similarly a voltage produced between a circuit node 31 and the bias source 20 equals twice the logarithm of the magnitude of the current $I_d$ because there are two junctions carrying that current.

A circuit 35 is arranged for converting the difference between the voltages on the nodes 30 and 31 into an output current $I_o$ which is conducted through a collector-emitter path of an NPN transistor 36 and an emitter-collector path of a PNP transistor 37 to the bias source 20. There are two base-emitter junctions of the opposite conductivity type transistors connected in a series aiding relationship in that path. The base electrodes of the transistors 36 and 37 are connected respectively to the nodes 30 and 31 so that the voltage difference between the nodes is applied across the series aiding connection of the base-emitter junctions of the transistors 36 and 37. Transistors 36 and 37 are biased to operate in the logarithmic portion of their characteristics. Betas are large enough that the base currents are negligible. Also series resistances of the transistors are negligible. A Kirchhoff voltage equation written at node 30 is:

$$2\frac{KT}{q}\ln\frac{I_a}{I_s}+2\frac{KT}{q}\ln\frac{I_b}{I_s}=2\frac{KT}{q}\ln\frac{I_o}{I_s}+2\frac{KT}{q}\ln\frac{I_d}{I_s}. \quad (1)$$

The diodes and the transistors are held at the same temperature, and the saturation current $I_s$ on the two sides of the equation balance.

Since the base-emitter junctions of both of the transistors 36 and 37 are connected in the series aiding circuit between the nodes 30 and 31, the voltage difference between the nodes produces the output current $I_o$ proportional to a square root of the voltage between the nodes 30 and 31. Current $I_o$ therefore also is proportional to the product of the magnitudes of the input currents $I_a$ and $I_b$ and is inversely proportional to the magnitude of the input current $I_d$. This relationship can be determined by an analysis of the Kirchhoff voltage equation (1) from which it can be shown that $$I_o=\left(\frac{I_a^2 I_b^2}{I_d^2}\right)^{\frac{1}{2}}=\frac{I_a I_b}{I_d}. \quad (2)$$

In the basic configuration of FIG. 1, it is possible to operate the circuit as an analog multiplier of just the two input currents $I_a$ and $I_b$ by making the magnitude of the input current $I_d$ equal to unity. Also when the input currents $I_a$ and $I_d$ are similar, the voltage at node 31 is similar to the voltage on the anode of the diode 16 so that the converting circuit 35 responds to the voltage difference across all or part of the string of junctions on the left side for producing the output current $I_o$.

All of the diodes and transistors are biased to hold those devices in the logarithmic portion of their operating characteristics for reasons described previously and so that input currents of either polarity may be applied without reverse biasing any of the junctions. The biasing arrangement enables the multiplier to operate as a four quadrant multiplier.

It is noted that the input and output connections provided by the arrangement of FIG. 1 are for single-ended operation. Thus simple input and output interconnections can be made. No single-ended to differential mode input conversion is needed, and no differential mode to single-ended output conversion is needed.

Figure 3:
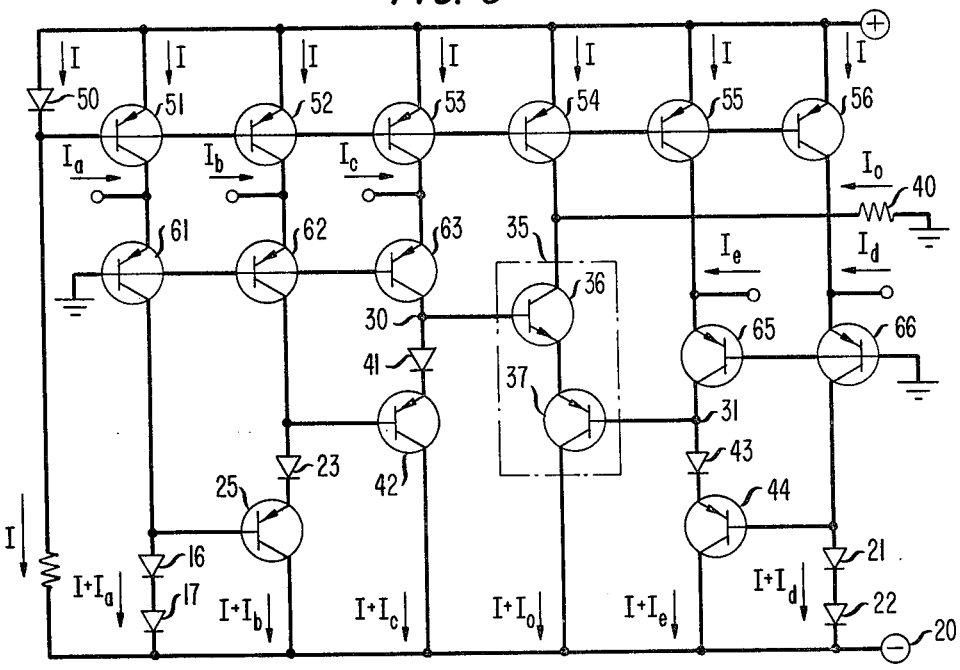
FIG. 3 is a schematic diagram of a circuit for computing a multiple of an input current or a product or ratio of plural input currents.

Referring now to FIG. 3, there is shown an exemplary arrangement of a monolithic analog integrated circuit similar to the arrangement of FIG. 1 but expanded to accommodate additional inputs and to show additional details of the input and biasing circuits. A bias current I is conducted through each branch circuit.

On the lefthand side of the converting circuit 35, there is an additional input current path for conducting another input current $I_c$ and the bias current I. The path includes a diode 41 and the emitter-collector path of a transistor 42. The transistor 42 has a high beta making the base current negligible and isolating the current $I+I_b$ from the current $I+I_c$. Diode 41 and the emitter-base junction of the transistor 42 are connected in a series aiding relationship with each other and with the string of junctions including diode 23, the emitter-base junction of the transistor 25 and the diodes 16 and 17.

On the righthand side of the converting circuit 35, there also is an additional branch for conducting yet another input current $I_e$ and the bias current I. A diode 43 and a transistor 44 are interconnected among the node 31, the biase source 20 and the anode of the diode 21 for conducting the input current $I_e$ and the bias current I through the diode 43 and the emitter-collector path of the transistor 44.

A diode 50 and a group of transistors 51 through 56 together with the bias supply 20 are arranged to supply the bias current I to each of the branches. All of the devices having a semiconductor junction connected between the node 30 and bias supply 20 are operated in the logarithmic portion of their characteristics. Transistors 61, 62, 63, 65 and 66 are arranged for conducting analog input currents $I_a$, $I_b$, $I_c$, $I_d$, and $I_e$ together with the bias current I through their respective branch circuits. Each of the input branches and the output branch is isolated from the current conducted in other branches by transistors, such as the transistors 25, 42, 36, 37 and 44.

A voltage difference between the nodes 30 and 31 determines the converting circuit branch current $I+I_o$. Depending upon the currents $I+I_a$, $I+I_b$ and $I+I_c$, the series aiding connection of junctions between the node 30 and the bias supply 20 determines the voltage on the node 30 to be proportional to the sum of twice the logarithms of the sums of the bias and input currents $I+I_a$, $I+I_b$ and $I+I_c$. Voltage on the node 31 is determined to be proportional to the sum of twice the logarithms of the sums of the bias and input currents $I+I_d$ and $I+I_e$. The Kirchhoff's voltage equation written at node 30 is $$2\frac{KT}{q}\ln\frac{(I+I_a)}{I_s}+2\frac{KT}{q}\ln\frac{(I+I_b)}{I_s}+2\frac{KT}{q}\ln\frac{(I+I_c)}{I_s}=2\frac{KT}{q}\ln\frac{(I+I_o)}{I_s}+2\frac{KT}{q}\ln\frac{(I+I_d)}{I_s}+2\frac{KT}{q}\ln\frac{(I+I_e)}{I_s}. \quad (3)$$

As described previously, with respect to equation (1) the devices operate at the same temperature, and the saturation currents balance on the two sides of the equation.

The voltage difference between the nodes 30 and 31 at the bases of the transistors 36 and 37 of the arrangement of FIG. 3 determines the output current $I_o$. Solution of the aforementioned Kirchhoff's voltage equation shows that the output current $$I_o=\left[\frac{(I+I_a)^2(I+I_b)^2(I+I_c)^2}{(I+I_d)^2(I+I_e)^2}\right]^{\frac{1}{2}}-I=\left[\frac{(I+I_a)(I+I_b)(I+I_c)}{(I+I_d)(I+I_e)}\right]-I. \quad (4)$$

The output current $I_o$, which is conducted through the load 40, contains various product terms of the input currents. These product terms are useful in specific applications.

Figure 4:
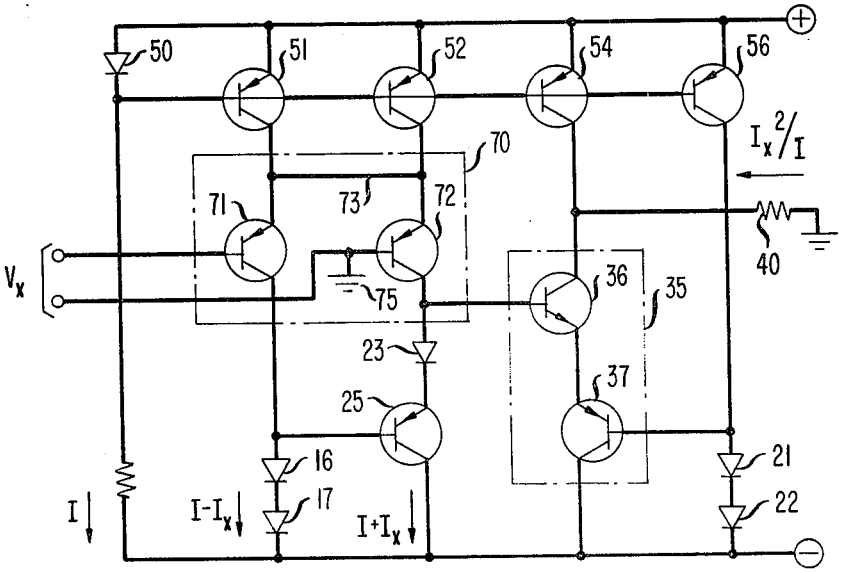
FIG. 4 is a schematic diagram of a squarer circuit.

Referring now to FIG. 4, there is shown an arrangement of the multiplier specifically designed as a squarer circuit. Most of the circuit arrangement is similar to the arrangement of FIG. 1. Those portions of the circuit which are similar to FIG. 1 will not be discussed except insofar as the differences in the arrangement affect their operation.

A salient change is the insertion of a differential pair 70 of PNP transistors 71 and 72 into the two input branch circuits to the left of the converting circuit 35. The emitters of the transistors 71 and 72 are interconnected directly by a lead 73. Emitter bias current is supplied respectively by the transistors 51 and 52. Collector output current of the transistor 71 is conducted through the diodes 16 and 17 to the bias supply 20. Collector output current of the transistor 72 is conducted through the diode 23 and the emitter-collector path of transistor 25 to the bias supply 20.

An input signal voltage $V_x$ is applied between the bases of the transistors 71 and 72. The base of the transistor 72 is referenced to ground potential 75.

Output circuits of the transistors 71 and 72 conduct both the bias current I and a signal current $I_x$. When the input voltage $V_x$ between the bases of the transistors 71 and 72 is zero volt, the collector currents equal the bias current I. If the input voltage $V_x$ goes slightly positive on the base of the transistor 71, a signal current $-I_x$, having a polarity opposing the polarity of the bias current I is generated in the collector of the transistor 71. Simultaneously a signal current $+I_x$, having a polarity the same as the polarity of the bias current, is generated in the collector of the transistor 72. Thus, a current $I-I_x$ is conducted through the diodes 16 and 17, and a current $I+I_x$ is conducted through the diode 23 and the emitter-collector path of the transistor 25.

A resulting output current $I_x^2/I$ is conducted through the collector circuits of the opposite conductivity type transistors 36 and 37 in the converter circuit 35 and through the load 40. This output current may be derived as follows:

$$I_{out}=\left[\frac{(I+I_x)(I-I_x)}{I}\right]-I=\frac{I_x^2}{I}+I_x-I_x+I-I=\frac{I_x^2}{I}. \quad (5)$$

It is noted that the output current is proportional to the input current squared.

The circuits of FIGS. 1, 3 and 4 show circuits with many transistors most of which are PNP type transistors. It is possible and in fact advisable to consider reversing the polarity of all devices and bias sources. The circuit designer then can choose whichever one of the designs is more appropriate for fabrication in whatever technology is available to the designer.

INTEGRATED CIRCUIT FABRICATION

This multiplier circuit arrangement may be particularly advantageous when it is constructed as an integrated circuit by a process which produces complementary bipolar transistors on a single semiconductor chip. One process which can be used for making the circuit is a process described in a now abandoned U.S. patent application, Ser. No. 658,586, filed on Feb. 17, 1976 in the names of W. E. Beadle, S. F. Moyer and A. A. Yiannoulos and entitled "Integrated Complementary Vertical Transistors".

Another process which can be used for making the circuit is a slightly modified version of the just mentioned process, described by Beadle et al. The modified version of the process can produce circuits including complementary bipolar transistors capable of operating at frequencies as high as the microwave frequency range. Changes in the process, described by Beadle et al, have been made to achieve minor scaling variations, such as a shortening of surface dimensions generally, a reduction of the vertical diffusion depths in the N epitaxial layer and in the P-wave substrate, and a reduction of the base widths to a range of 0.15–0.25 $\mu$M.

The process described by Beadle et al, is followed step by step with some adjustments in dopant levels and heat treatments until the step which forms the N-type base zones for the PNP transistors. Commencing with that step, the processing is designed to provide devices with geometries having smaller surface dimensions and narrower base widths in order to increase the gain-bandwidth product of those devices.

From the beginning, the modified process proceeds through the following sequence of steps which are described briefly herein for convenience. Readers who desire more details of the process are referred to the Beadle et al patent application.

The process is begun by selecting a suitable P-type conductivity silicon wafer for the substrate upon which the integrated circuit is to be formed. Before the first step of the process and after the epitaxial layer is deposited, an initial oxide is formed over the surface of the wafer to serve as a mask during the subsequent processing steps. Prior to each step, one or more openings are made in the oxide to permit access to the semiconductor material. After each step is completed, up to but not including the emitter steps, the wafer is heated in an oxidizing atmosphere to close the openings in the mask before making any other appropriate openings for the subsequent processing step.

In the first actual processing step, lightly doped N-type isolation zones are formed under the desired locations of the collectors of the PNP transistors. Doping is accomplished by ion implantation of phosphorus. It is followed by a heat treatment in an oxidizing ambient to diffuse the phosphorus and to close the openings in the oxide layer.

Next N-type low resistance collector zones for the NPN transistors are formed by ion implantation of either arsenic or antimony.

Thereafter in the first-formed N-type isolation zones, the P-type collector zones for the PNP transistors are formed by implanting boron. Simultaneously P-type isolation zones for isolating the NPN transistors also are formed by the boron implantation.

Subsequently an N-type conductivity epitaxial layer is formed by vapor deposition over the wafer surface after the oxide layer is removed. Heat from the vapor deposition causes out-diffusion from the substrate into the epitaxial layer.

The process is continued by predepositing and diffusing phosphorus to form collector connection zones for the NPN transistors and isolation zones for the PNP transistors.

Next impurities for P-type isolation zones of the NPN transistors and a PNP collector contacts are introduced into the epitaxial layer by ion implantation of boron or aluminum. Heat treatment drives the impurities which are introduced into the epitaxial layer, into their appropriate geometries.

During the next operation epitaxial conversion zones, for forming the collectors of the PNP transistors, are defined by introducing boron or aluminum into the epitaxial layer by ion implantation. A heat treatment causes the buried collectors and epitaxial conversion diffusions to cross and form continuous isolated collector regions.

Now the N-type base zones for the PNP transistors are formed by a two-step ion implantation of phosphorus or arsenic. While forming the N-type base zones of the PNP transistors, the process described by Beadle et al is changed by using smaller mask openings and a shorter period of time for the heat treatment. Fewer ions are implanted through the scaled down mask opening. With respect to the results expected from the process described by Beadle et al, these changes shorten the lateral and vertical dimensions of the bases and the base depths while maintaining the impurity levels of the zones. The magnitudes of the changes in the dimensions and time periods depend upon how much increase in the gain-bandwidth product is desired by the designer.

Next the P-type base zones of the NPN transistors are formed by a two-step ion implantation of boron into the epitaxial layer. During this step mask openings are scaled down from those used for the Beadle et al process. Also the dose of the two-step implantation of the boron and the duration and temperature of the heat treatment are reduced. With respect to the results expected from the process described by Beadle et al, these changes shorten the lateral dimensions of the bases and the base depths while maintaining the impurity level of the zones. Once again the magnitudes of the changes in the dimensions and the time periods depend upon how much increase in the gain-bandwidth product is desired.

Following the formation of the P-type base zones, the integrated circuit is heat treated in an atmosphere of silicon nitride to form a protective layer over its surface. After the protective layer is completed, self-aligned emitters are formed in both types of transistors by successive ion implantations after suitable openings are defined in the protective layer. The first emitters to be formed are the emitters of the NPN transistors. These N-type emitters are formed by implanting ions of arsenic through small mask openings at a lower implantation energy for shortening surface dimensions while maintaining the impurity level of the zones. Following the formation of the N-type emitters, the emitters of the PNP transistors are formed by implanting ions of boron over a short time through small mask openings at a lower implantation energy for shortening the surface dimensions while maintaining the impurity level of the zones. Each of the ion implantations for the base zones is accomplished in two stages. In the first stage utilizing a high energy implant, ion implantation achieves a desired Gummel number. In the second stage utilizing a low energy implant, ion implantation achieves the desired surface concentration.

During the two emitter implantations, the base contact windows in the other type of transistors also receive the emitter implant to provide enhanced base contacts.

The foregoing describes several embodiments of the invention and methods for fabricating the same. These embodiments together with other embodiments obvious to those skilled in the art are considered to be within the scope of the invention.

What is claimed is:

1. An analog multiplier circuit comprising plural sources of input currents;

a series aiding connected string of semiconductor junctions, each semiconductor junction being arranged for conducting an input current from one of the sources and producing a voltage proportional to a logarithm of the input current conducted therethrough; and means responsive to voltages at opposite ends of the string of junctions for converting a sum of the produced voltages into an output current proportional to the produce of the plural input currents.

2. An analog multiplier circuit in accordance with claim 1 wherein the plural sources of input currents comprise a differential amplifier for converting an input voltage into equal but oppositely polarized input signal currents in separate ones of the string of junctions, and the output current is proportional to the square of one of the input signal currents.

3. A monolithic integrated multiplier circuit comprising plural sources of input currents;

a series aiding connection of semiconductor junctions, each semiconductor junction being arranged for conducting an input current from one of the sources and producing a voltage proportional to a logarithm of the input current conducted through that junction; and a pair of opposite conductivity type transistors having their emitters connected together and their bases responsive respectively to voltages at opposite ends of the series aiding connection for converting the voltage produced across the connection of semiconductor junctions into an output current proportional to the product of the input currents.

4. A monolithic integrated multiplier curcuit in accordance with claim 3 wherein the plural sources of input currents comprise a differential amplifier for converting an input voltage into equal but oppositely polarized input signal currents in separate ones of the semiconductor junctions, and the output current is proportional to the square of one of the input signal currents.

5. A monolithic integrated multiplier circuit in accordance with claim 3 wherein the magnitude of the voltage produced across the connection of semiconductor junctions is proportional to the sum of the logarithms of the magnitudes of the input currents, and the magnitude of the output current conducted through collector circuits of the pair of opposite conductivity type transistors is proportional to the product of the magnitudes of the plural input currents.

6. A monolithic integrated multiplier circuit in accordance with claim 3 further comprising means connected with the semiconductor junctions and the pair of opposite conductivity type transistors for biasing the junctions and the transistors to operate in the logarithmic portion of their characteristics.

7. A monolithic integrated multiplier circuit in accordance with claim 3 wherein two semiconductor junctions connected in series conduct each input current.

8. A current ratio circuit comprising first means for generating a first voltage proportional to a sum of logarithms of the magnitudes of a group of currents;

second means for generating a second voltage proportional to a logarithm of the magnitude of a different current;

means connected with the first and second means and responsive to a difference between the first and second voltages for producing an output current directly proportional to a product of the currents of the group of currents and inversely proportional to the different current;

a group of current sources for supplying the group of currents to the first means;

a different current source for supplying the different current to the second means;

the first means including a first string of semiconductor junctions connected in series, each semiconductor junction conducting one of the group of currents, the first string of semiconductor junctions producing the first voltage thereacross; and the second means including one or more semiconductor junctions connected in series for conducting the different current and producing the second voltage thereacross.

9. A current ratio circuit in accordance with claim 8 wherein the output current producing means include a pair of opposite conductivity type transistors, interconnected emitter-to-emitter and responsive to the first and second voltages, applied respectively to their bases, for producing the output current in their collector circuits.

10. A current ratio circuit in accordance with claim 9 further comprising means connected with the first and second means and with the producing means for biasing the pair of transistors and the semiconductor junctions of the first and second means to operate in the logarithmic portion of their characteristics.

11. A current ratio circuit in accordance with claim 10 wherein the first and second means and the output current producing means are fabricated as a monolithic integrated circuit.

* * * * *